US009786216B2

(12) United States Patent
Tatsumi

(10) Patent No.: US 9,786,216 B2
(45) Date of Patent: Oct. 10, 2017

(54) DISPLAY APPARATUS, LIGHT-EMITTING DEVICE, AND CONTROL METHOD OF DISPLAY APPARATUS

(71) Applicant: CANON KABUSHIKI KAISHA, Tokyo (JP)

(72) Inventor: Eisaku Tatsumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 382 days.

(21) Appl. No.: 14/469,437

(22) Filed: Aug. 26, 2014

(65) Prior Publication Data

US 2015/0062103 A1 Mar. 5, 2015

(30) Foreign Application Priority Data

Aug. 30, 2013 (JP) ..... 2013-180123

(51) Int. Cl.
*G09G 3/30* (2006.01)
*G09G 3/34* (2006.01)
*G09G 3/36* (2006.01)

(52) U.S. Cl.
CPC ..... *G09G 3/30* (2013.01); *G09G 3/342* (2013.01); *G09G 3/3426* (2013.01);
(Continued)

(58) Field of Classification Search
CPC ..... G06F 3/0416; G09G 3/30; G09G 3/342; G09G 3/3426; G09G 3/3611; G09G 2310/024; G09G 2310/063; G09G 2320/0247; G09G 2320/0261;
(Continued)

(56) References Cited

U.S. PATENT DOCUMENTS

2001/0003448 A1* 6/2001 Nose ..... G09G 3/3648 345/99
2004/0207649 A1* 10/2004 Shih ..... G09G 3/3648 345/690
(Continued)

FOREIGN PATENT DOCUMENTS

JP 2006-189658 A 7/2006
JP 2009-251069 A 10/2009
(Continued)

OTHER PUBLICATIONS

European Application No. 14182522.4-1972, Communication pursuant to Article 94(3) EPC, dated Mar. 21, 2016.
(Continued)

*Primary Examiner* — Kumar Patel
*Assistant Examiner* — Sejoon Ahn
(74) *Attorney, Agent, or Firm* — Canon USA, Inc. I.P. Division

(57) ABSTRACT

To reduce the occurrence of flicker in an image with almost no movement and reduce the occurrence motion blur in an image with movement, an image processing apparatus detects movement information from acquired image data. The image processing apparatus causes a display unit to perform first light emission to display a first frame, and also causes the display unit to perform second light emission to display a second frame, the first frame and the second frame corresponding to one frame of the acquired image data. The image processing apparatus controls at least either light emission time periods of the first light emission and the second light emission or light emission luminances of the first light emission and the second light emission based on the movement information.

19 Claims, 16 Drawing Sheets

(52) U.S. Cl.
CPC ..... *G09G 3/3611* (2013.01); *G09G 2310/024* (2013.01); *G09G 2310/063* (2013.01); *G09G 2320/0247* (2013.01); *G09G 2320/0261* (2013.01); *G09G 2320/064* (2013.01); *G09G 2320/0633* (2013.01); *G09G 2320/0646* (2013.01); *G09G 2320/106* (2013.01); *G09G 2340/0435* (2013.01); *G09G 2360/16* (2013.01)

(58) Field of Classification Search
CPC ..... G09G 2320/0633; G09G 2320/064; G09G 2320/0646
See application file for complete search history.

(56) References Cited

U.S. PATENT DOCUMENTS

2006/0001499 A1* 1/2006 Tatsumi ..... G09G 3/22 332/103
2006/0146005 A1 7/2006 Baba et al.
2008/0007183 A1* 1/2008 Tatsumi ..... H05B 41/2855 315/160
2008/0111835 A1* 5/2008 Hu ..... G09G 3/3611 345/690
2012/0081419 A1 4/2012 Abe

FOREIGN PATENT DOCUMENTS

JP 2011-013558 A 1/2011
JP 2011-164435 A 8/2011
JP 2012-078590 A 4/2012

OTHER PUBLICATIONS

European Search Report for App. No. EP 14182522.4, dated Jan. 21, 2015.

* cited by examiner

SCANNING EMISSION

HOLD + BLACK INSERTION

TWO IMPULSE EMISSIONS

IMPULSE EMISSION +
DARK AND LONG EMISSION

FIG.12

121

| | | | | |
|---|---|---|---|---|
| P1 | P1 | P3 | P1 | P1 |
| P1 | P1 | P3 | P1 | P1 |
| P1 | P10 | P6 | P4 | P1 |
| P1 | P8 | P8 | P1 | P2 |
| P1 | P10 | P7 | P5 | P1 |
| P1 | P1 | P3 | P1 | P1 |
| P1 | P1 | P3 | P6 | P1 |
| P1 | P1 | P1 | P1 | P1 |

122

| | | | | |
|---|---|---|---|---|
| P1 | P2 | P2 | P1 | P1 |
| P1 | P3 | P3 | P2 | P1 |
| P2 | P6 | P6 | P4 | P2 |
| P2 | P8 | P6 | P4 | P1 |
| P2 | P6 | P6 | P3 | P2 |
| P1 | P3 | P3 | P3 | P1 |
| P1 | P1 | P3 | P3 | P2 |
| P1 | P1 | P1 | P2 | P1 |

123

| | | |
|---|---|---|
| | x1 | |
| x1 | x2 | x1 |
| x1/6 | x1 | |

124

| | | |
|---|---|---|
| | x1 | |
| | x3 | x1 |
| x1/6 | x1 | |

125

| | | |
|---|---|---|
| | x4 | x1 |
| x1/6 | x1 | |

DISPLAY APPARATUS, LIGHT-EMITTING DEVICE, AND CONTROL METHOD OF DISPLAY APPARATUS

BACKGROUND OF THE INVENTION

Field of the Invention

The present invention relates to a display apparatus, a light-emitting device, and a control method of a display apparatus, and in particular, relates to a suitable technique used to achieve both the visibility of a moving image and the prevention of flicker in a display apparatus in which a light-emitting device emits light to display an image on a hold-type display device such as a liquid crystal panel.

Description of the Related Art

Conventionally, if a display apparatus using a liquid crystal panel displays an image with movement, image retention called motion blur occurs. Thus, generally, display is performed by multiplying a frame frequency of 60 Hz or 50 Hz by a constant value, and also hold time is shortened to eliminate the influence of motion blur caused by the hold time.

To multiply the frame frequency by a constant value, it is required to generate intermediate image data to be displayed in a new frame. If, however, the original image includes image data having a striped pattern, intermediate image data is erroneously generated, which causes a sense of distortion in an image.

On the other hand, if the hold time is consistently shortened with the frame frequency remaining at 60 Hz or 50 Hz to reduce motion blur, flicker occurs. This makes the resulting image difficult to see.

Particularly with a master monitor or a picture monitor used to check an image, the hold time is fixed to a value of about 50% as a percentage in one frame time (a duty ratio). The fixed duty cycle causes motion blur in a fast moving portion or causes flicker in a bright image, depending on the image.

Thus, it is required to minimize the occurrence of motion blur and flicker with the frame frequency remaining at 60 Hz or 50 Hz. Further, it is also required to make inconspicuous the sense of obstruction caused by the intermediate image data generated when the frame frequency is multiplied by a constant value.

Japanese Patent Application Laid-Open No. 2006-189658 and Japanese Patent Application Laid-Open No. 2011-13558 discuss a technique for detecting a motion vector and controlling hold time according to the detected motion vector. Japanese Patent Application Laid-Open No. 2012-78590 discusses a technique for detecting a motion vector and controlling hold time for each block of a backlight according to the detected motion vector. Japanese Patent Application Laid-Open No. 2009-251069 discusses a technique for controlling hold time based on the luminance level of a partial area in display.

However, to control the hold time (duty ratio) of light emission using a motion vector, there is no choice but to shorten the hold time in a case of an image with great movement. If the hold time is shortened in a single light emission, flicker occurs in a case of a bright image. If light emission is repeated twice with a short hold time to prevent flicker, a portion with movement is seen twice, and an obstruction called double blurring (i.e., ghosting) appears.

Further, to control the hold time based on the luminance level of a partial area in display, there is no choice but to lengthen the hold time in an image including a bright area. However, this causes motion blur in a portion with movement.

SUMMARY OF THE INVENTION

According to an aspect of the present invention, a display control apparatus includes an acquisition unit configured to acquire image data, a detection unit configured to detect movement information from the image data, and a control unit configured to cause a display unit to perform first light emission to display a first frame, and also cause the display unit to perform second light emission to display a second frame, of the first frame and the second frame corresponding to one frame of the acquired image data, and to control at least either light emission time periods of the first light emission and the second light emission or light emission luminances of the first light emission and the second light emission based on the movement information, wherein the light emission time periods of the first light emission and the second light emission are different from each other.

Further features of the present invention will become apparent from the following description of exemplary embodiments with reference to the attached drawings.

BRIEF DESCRIPTION OF THE DRAWINGS

FIG. 12 is a diagram illustrating a method of determining patterns, according to an exemplary embodiment.

DESCRIPTION OF THE EMBODIMENTS

An exemplary embodiment according to the present invention will be described in detail below with reference to the accompanying drawings.

Figure 1A:
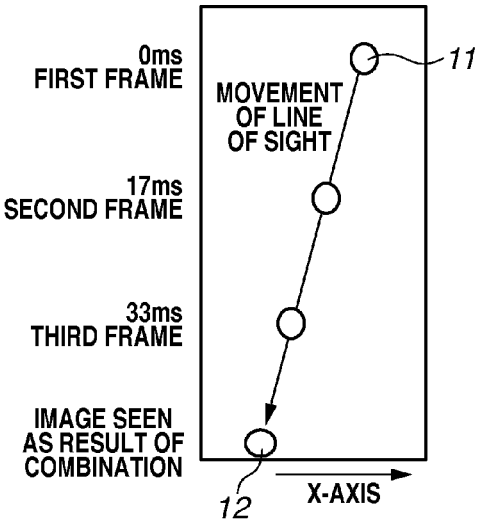
FIGS. 1A, 1B, 1C, and 1D are diagrams illustrating appearances of various images.
Figure 1B:
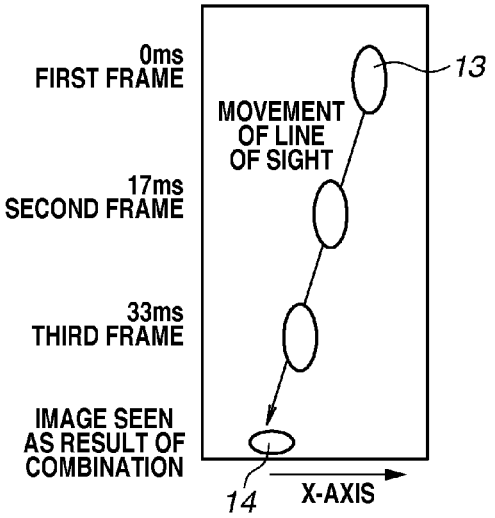
Figure 1C:
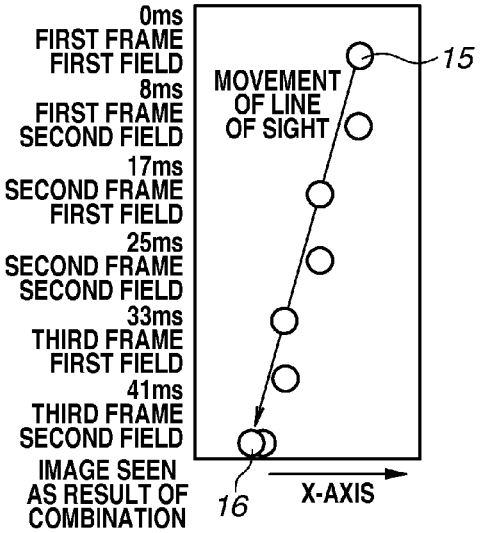
Figure 1D:
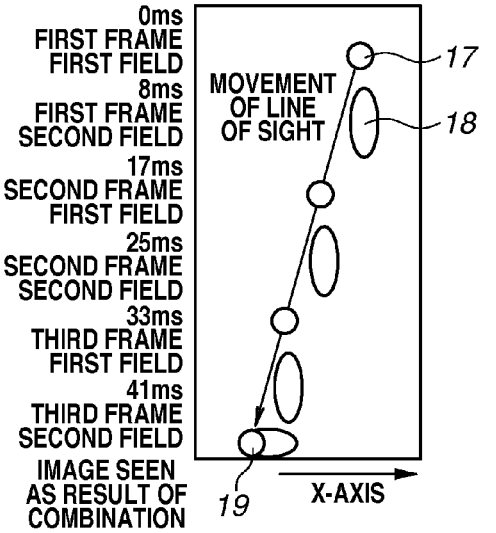

First, with reference to FIGS. 1A, 1B, 1C, and 1D, appearances of various images are described. FIG. 1A illustrates the appearance of display at a frame frequency of 60 Hz when impulse light emission is performed. FIG. 1B illustrates the appearance of display at a frame frequency of 60 Hz when black is inserted into hold light emission. FIG. 1C illustrates the appearance of display when a frame frequency of 60 Hz includes two fields and impulse light emission is performed twice. FIG. 1D illustrates the appearance of display when a frame frequency of 60 Hz includes two fields and impulse light emission and long and dark light emission are performed in combination.

In each of FIGS. 1A, 1B, 1C, and 1D, a displayed object is spherical and moves from the right to the left in each frame. In each of FIGS. 1A, 1B, 1C, and 1D, the vertical axis represents time. In a case of an image having a frame frequency of 60 Hz, the image switches every 17 ms. In each of FIGS. 1A, 1B, 1C, and 1D, the movement of the line of sight is indicated by an arrow. Further, image data obtained as a result of the combination of frames along the movement of the line of sight (image data visible to a viewer) is illustrated at the bottom.

In FIG. 1A, a shape 11 is the shape of an image of a sphere seen in one frame under impulse light emission. A shape 12 is a shape of an image of a sphere seen as a result of the combination of several frames under impulse light emission.

In FIG. 1B, a shape 13 is a shape of an image of a sphere seen in one frame under hold light emission. A shape 14 is a shape of an image of a sphere seen as a result of the combination of several frames under hold light emission.

In FIG. 1C, a shape 15 is the shape of an image of a sphere seen in one field under impulse light emission. A shape 16 is the shape of an image of the sphere seen as a result of the combination of several frames under impulse light emission.

In FIG. 1D, a shape 17 is a shape of an image of a sphere seen in one field under impulse light emission. A shape 18 is a shape of an image of a sphere seen in one field under long and dark light emission. A shape 19 is a shape of an image of a sphere seen as a result of the combination of several frames under hold light emission.

In FIG. 1A, only the original image data is displayed in each frame under impulse light emission. The appearance of each image of the image data is close to spherical as illustrated in the shape 11. The image data seen as a result of the combination of several frames is close to spherical as in the shape 12. Thus, the appearance of the movement of the object is most excellent. If, however, impulse light emission is performed at a frame frequency of 60 Hz, terrible flicker occurs on a bright screen, which leads to a great deterioration in the image quality.

In FIG. 1B, only the original image data is displayed in each frame under hold light emission. The time during which light is emitted is long as illustrated in the shape 13 (hold-type light emission display). If these images in several frames are added together in the moving direction of the line of sight, then as illustrated in the shape 14, the sphere appears to be deformed into an ellipse along an X-axis direction. Since the hold time is reduced to about half by inserting black, the degree of deformation is somewhat less objectionable, but the sphere still deforms. The further lengthening of the time of black insertion prevents deformation. However, conversely, the light emission comes close to impulse light emission, and therefore becomes similar to that in FIG. 1A, which causes severe flicker.

Cases have been described where light is emitted only once in each frame. Next, cases are described where each frame includes two fields and light is emitted twice in the frame. Here, cases are described where the original image data is used in both two fields. The appearance of the image data when the original image data is used in a first field and intermediate image data is used in a second field will be described in a fifth exemplary embodiment.

In FIG. 1C, impulse light emission is repeated in two fields, thereby displaying only the original image data in each frame. The two repetitions of light emission result in a frequency of 120 Hz and do not cause flicker. The appearance of the image data, however, is such that the sphere appears twice as illustrated in the shape 16. This is a sense of distortion called double blurring or ghosting.

In FIG. 1D, impulse light emission is performed in a first field, and long and dark light emission is performed in a second field, thereby displaying only the original image data in each frame. Although there is a difference in light and dark between the two fields, the two repetitions of light emission result in a frequency of 120 Hz and reduce flicker. Then, the appearance of the image data is such that the sphere and dark tailing appear together as illustrated in the shape 19. This is close to a desirable natural appearance in which the sphere and pale tailing behind the movement of the sphere are seen.

Further, the ratio of the sphere to the pale tailing may be dynamically changed according to the amount of movement of the image data. Thus, if the tailing is long due to a large movement, the tailing can be decreased. If the movement is small, the tailing can be deepened, i.e., increased. This comes closer to a natural appearance.

Next, a first exemplary embodiment of the present invention is described. First, the terms representing the intensity of light emission and used in the description of the first exemplary embodiment are defined as follows.

An "integrated luminance" is the same as a normal luminance. In the description of the present exemplary embodiment, however, the term "integrated luminance" is used to distinguish it from an instantaneous luminance.

A "light emission luminance" is an instantaneous luminance and is obtained by dividing the "integrated luminance" by the proportion of a light emission time period (a duty ratio). If the duty ratio is 1, the "light emission luminance" is equal in value to the "integrated luminance". If, for example, the duty ratio is 0.2, the value of the "light emission luminance" is five times the value of the "integrated luminance". Further, a "light emission intensity" is a value indicating the proportion (i.e., ratio) of the light emission intensity to the maximum light emission intensity.

Figure 2:
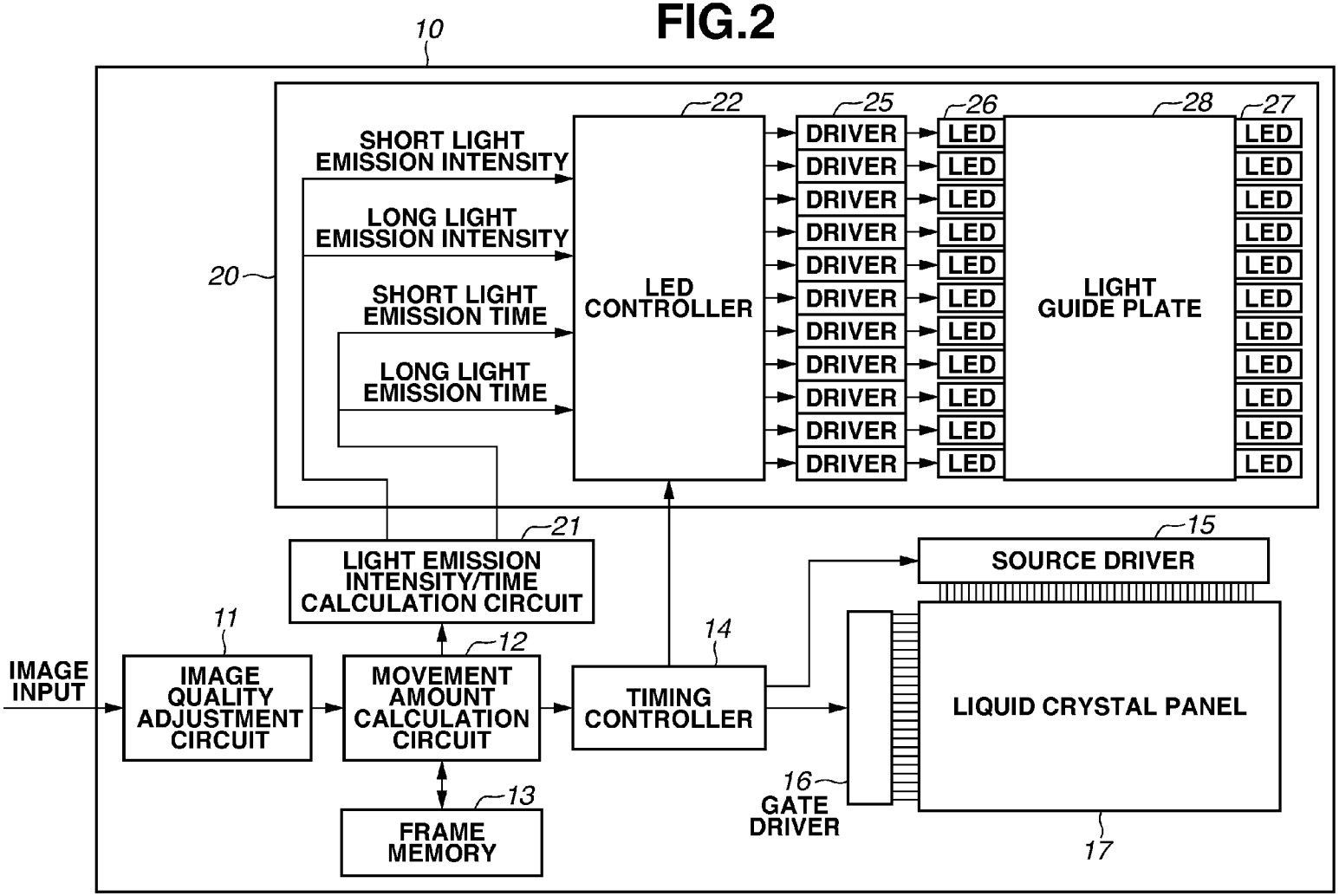
FIG. 2 is a block diagram illustrating an example of a configuration of a display apparatus according to an exemplary embodiment.

FIG. 2 is a diagram illustrating an internal configuration of a display apparatus according to the first exemplary embodiment of the present invention. A display apparatus 10 according to the present exemplary embodiment includes a light-emitting device (backlight device) 20. The light-emitting device 20 employs a scanning method in which a plurality of light-emitting diodes (LEDs) emits light in order of the arrangement of said LEDs.

In FIG. 2, an image quality adjustment circuit 11 adjusts a image quality according to the display apparatus and viewer settings. A movement amount calculation circuit 12 detects an amount of movement of image data. A frame memory 13 stores the previous frame for the movement amount calculation circuit 12 to compare two frames. The movement amount calculation circuit 12 detects the amount of movement indicating the ease of occurrence of motion blur based on input image information.

A timing controller 14 controls timing of a panel module and a backlight module. A source driver 15 is used to drive a liquid crystal panel. A gate driver 16 is used to drive a liquid crystal panel. A liquid crystal panel 17 serves as a spatial modulation device and is an example of a hold-type display device.

A light emission intensity/time calculation circuit 21 calculates the light emission intensity and the light emission time period of LEDs according to an amount of movement. An LED controller 22 controls LED drivers according to the light emission intensity and the light emission time period calculated by the light emission intensity/time calculation circuit 21. Drivers 25 drive LEDs. LEDs 26 are arranged vertically in a line on the left and serve as a light-emitting unit. LEDs 27 are arranged vertically in a line on the right and serve as a light-emitting unit. A light guide plate 28 guides the light from the left LEDs 26 and the right LEDs 27 in horizontal bands.

Next, the general operation of the display apparatus 10 is described.

The image quality adjustment circuit 11 adjusts the image quality of an image signal (YPbPr signal) input to the display apparatus 10, using the characteristics of the liquid crystal panel 17 and the preference of the viewer as parameters, generates optimal image data, and outputs the image data as red, green, and blue (RGB) signals. The RGB signals output from the image quality adjustment circuit 11 are input to the movement amount calculation circuit 12. The movement amount calculation circuit 12 compares the previous frame stored in the frame memory 13 with the present frame, thereby detecting the amount of movement of the image data.

The timing controller 14 transmits, to the source driver 15 of the liquid crystal panel 17, gray scale data obtained by converting the RGB signals into digital values indicating voltages. Further, the timing controller 14 transmits a timing signal for scanning at 60 Hz to the gate driver 16. The gate driver 16 and the source driver 15 drive the source and gate electrodes of the liquid crystal panel 17 and also drive the common electrode (not illustrated), thereby displaying the image data on a screen.

Next, the operation of the light-emitting device 20 is described.

The light emission intensity/time calculation circuit 21 determines, by using calculation formulas described below, the light emission intensity and the light emission time period of the LEDs using the amount of movement detected by the movement amount calculation circuit 12, and writes the determined light emission intensity and light emission time period to a register of the LED controller 22. The LED controller 22 converts the values written in the register into a driving voltage and an output time, thereby driving the drivers 25. The drivers 25 drive the left LEDs 26 and the right LEDs 27 based on a current proportional to the input voltage. For example, if a current having a current value of 20 mA is applied when light is emitted from the left LEDs 26 (a first light-emitting unit) and the right LEDs 27 (a second light-emitting unit), a voltage value corresponding to the current setting value is set to 2 V. Further, if a current having a current value of 4 mA is applied when light is emitted, a voltage value corresponding to the current setting value is set to 0.4 V.

Further, the LED controller 22 controls a so-called scanning operation for sequentially shifting the operation of turning on and then off each driver 25 from an upper driver to a lower driver. The time each driver 25 is turned on is controlled to be made equal to the hold time for obtaining a desired duty ratio. The driven LEDs emit light in a bright or dark manner based on the current value. The light from the left LEDs 26 and the right LEDs 27 is guided in a horizontal bands by the light guide plate 28, and the front surface of the light guide plate 28 emits light in a band-like manner. As described above, the image data to be displayed on the liquid crystal panel 17 is displayed by light emission by the light-emitting device 20 in a scanning manner.

In the present exemplary embodiment, the timing controller 14 controls the current flowing through the LEDs and the hold time. This is to obtain both short and bright light emission and long and dark light emission, or short and bright light emission alone, in one frame.

FIGS. 3A, 3B, 3C, and 3D are diagrams illustrating a light emission state of the light-emitting device 20 according to the first exemplary embodiment.

Figure 3A:
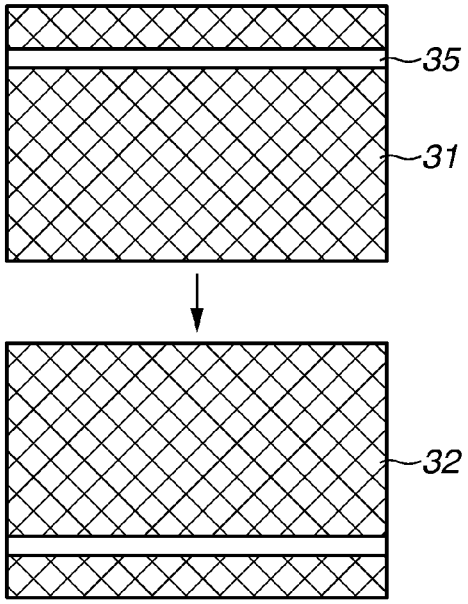
FIGS. 3A, 3B, 3C, and 3D are diagrams illustrating a light emission state of a light-emitting device according to an exemplary embodiment.
Figure 3B:
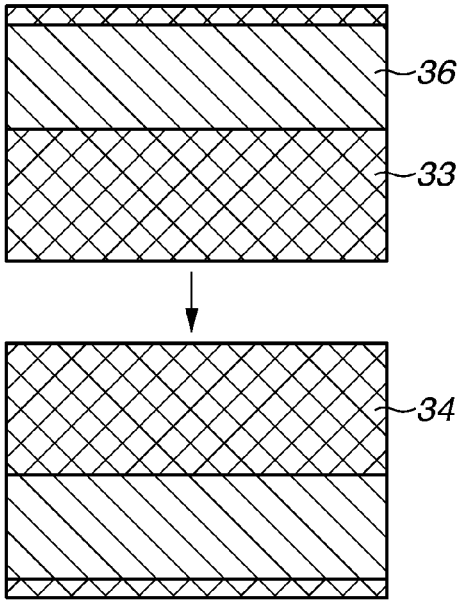
Figure 3C:
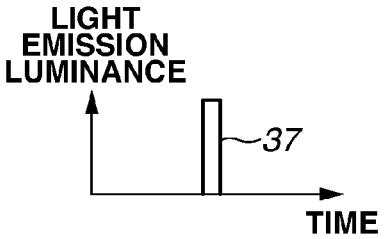
Figure 3D:
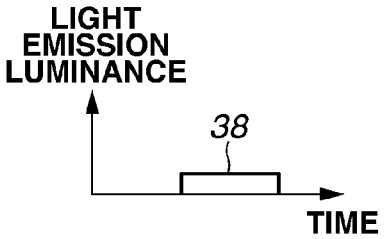

FIGS. 3A and 3B are diagrams illustrating transition of the light emission state according to time lapsed. The outline in each diagram represents an area where the light-emitting device 20 can emit light and which coincides with the display area of the liquid crystal panel 17. FIGS. 3C and 3D illustrate a relationship between the time and the light emission luminance in a line near the center and each illustrate the time lapsed in one field.

FIG. 3A illustrates a case where a light emission state 31, where the first half of an image is displayed at a short duty ratio, transitions to a light emission state 32, where the second half of the image is displayed at the short duty ratio. Further, FIG. 3A illustrates bright and short and bright light emission 35.

FIG. 3B illustrates a case where a light emission state 33, where the first half of an image is displayed at a long duty ratio, transitions to a light emission state 34, where the second half of the image is displayed at the long duty ratio. Further, FIG. 3B illustrates long and dark light emission 36.

FIG. 3C illustrates a light emission luminance change 37 in a line near the center when the image is displayed at the short duty ratio. FIG. 3D illustrates a light emission luminance change 38 in a line near the center when the image is displayed at the long duty ratio.

In FIG. 3A, the time during which the liquid crystal panel 17 displays the image data is from slightly before the light emission state 31 to slightly after the light emission state 32. In other words, the time is from when the LEDs at the top end start emitting light, to when the short and bright light emission 35 scans from top to bottom, to when the LEDs at the bottom end finish emitting light.

In FIG. 3B, on the other hand, the time is from slightly before the light emission state 33 to slightly after the light emission state 34. In other words, the time is from when the LEDs at the top end start emitting light, to when the dark and thick light emission 36 scans from top to bottom, to when the LEDs at the bottom end finish emitting light.

If attention is paid to one line in the horizontal direction, the image data at the short duty ratio emits light for a short time with a high light emission luminance as in the light emission luminance change 37 illustrated in FIG. 3C. On the other hand, the image data at the long duty ratio emits light for a long time with a low light emission luminance as in the light emission luminance change 38 illustrated in FIG. 3D.

The LED controller 22 controls such light emission patterns of the light-emitting device 20 according to the amount of movement of the image. This enables display with the highest possible responsiveness to movement in the range where flicker is unlikely to occur.

Figure 4A:
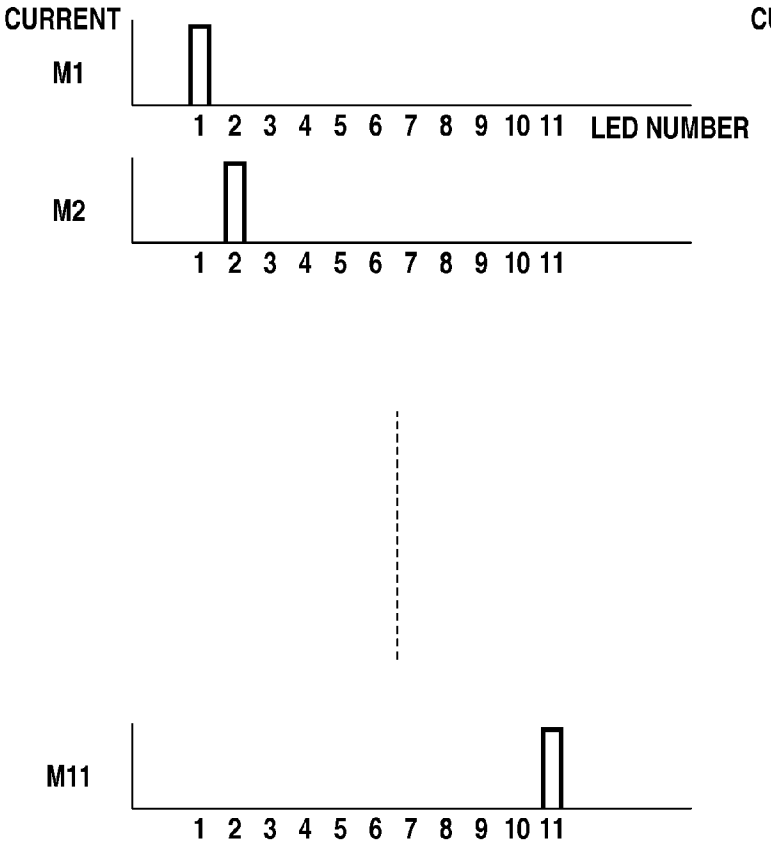
FIGS. 4A and 4B are diagrams illustrating changes in current flowing in LEDs.
Figure 4B:
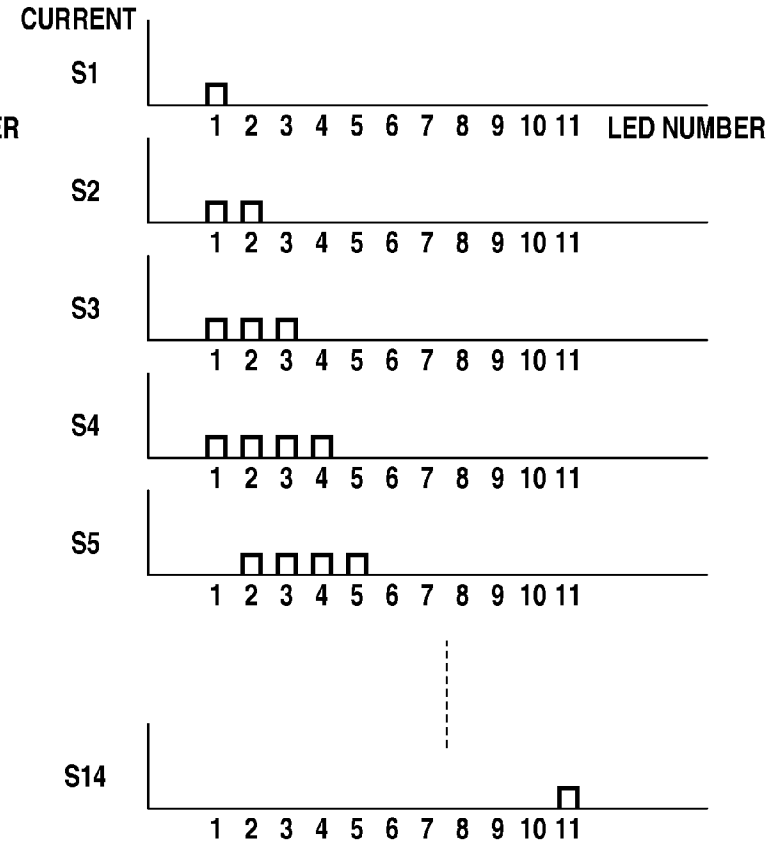

Next, with reference to FIGS. 4A and 4B, a change in the current actually flowing through the LEDs is described.

In FIGS. 4A and 4B, the numbers of the LEDs from top to bottom (1 to 11) are assigned on the horizontal axis. For ease of description, the number of LEDs is eleven on either left or right side. If, however, the light-emitting device 20 is used for the liquid crystal panel 17 having a larger screen, the number of LEDs is greater. Further, the vertical axis represents the current value.

To cause the LEDs to perform short and bright light emission, the light emission is caused to transition from M1, M2 to M11 as illustrated in FIG. 4A with the lapse of time. To cause the LEDs to perform long and dark light emission, the light emission is caused to transition from S1, S2 to S14 as illustrated in FIG. 4B with the lapse of time. In a case of an image having a frame frequency of 60 Hz, each cycle is equivalent to about 17 ms.

At M1 illustrated in FIG. 4A, the LED 1 at the top lights up brightly. If the light emission has transitioned to M2, the LED 1 goes out and the LED 2 lights up brightly. The light emission continues to transition by sequentially scanning downward. Then, at M11, the LED 11 at the bottom lights up brightly. In a down period thereafter, all the LEDs are out.

At S1 illustrated in FIG. 4B, the LED 1 at the top lights up darkly. If the light emission has transitioned to S2, the LED 2 also lights up darkly with the LED 1 remaining lit up. Until S3 and S4, the light emission transitions such that the number of LEDs that light up increases. At S5, the LED 1 goes out, and the LED lights up darkly. After S6, similarly, the light emission transitions such that one LED is turned off and another LED is turned on. Then at S14, only the LED 11 at the bottom is lit up. In a down period thereafter, all the LEDs are out.

As described above, the LED controller 22 controls the current of the LEDs and the hold time. Thus, it is possible to achieve the light emission patterns of the light-emitting device 20 as illustrated in FIGS. 3A and 3B. It is required to bring the middle of the light emission time period into almost the same phase in each frame. This is because, if the phase shifts, a beat occurs at low frequencies, which causes flicker.

Next, a description is given of what light emission luminance and light emission time period are actually appropriate based on human visual characteristics when the light emission luminance and the light emission time period are controlled according to the amount of movement.

In the present exemplary embodiment, subjective evaluations are made based on five-point stages, and an evaluation criterion for each point for stages (1) and (2) is set as follows.

(1) Subjective Evaluation Value of Flicker
5: Do not feel flicker at all.
4: Recognize the presence of slight flicker.
3: Feel bearable flicker.
2: Feel unbearable flicker.
1: Flicker is too strong to see the image.
(2) Subjective Evaluation Value of Motion Blur
5: Do not see motion blur at all.
4: Recognize the presence of slight motion blur.
3: There is bearable motion blur.
2: There is unbearable motion blur.
1: There is too much motion blur to see the image.

In the following description, each of the evaluation values 5 is a sensing limit, each of the evaluation values 4 is an acceptance limit, and each of the evaluation values 3 is a bearable limit.

FIGS. 5A, 5B, and 5C to FIGS. 7A, 7B, and 7C are diagrams illustrating the results of experiment, by subjective evaluations, on visual characteristics for determining the control values of the light emission luminance and the light emission time.

Figure 5A:
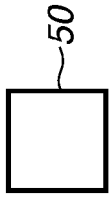
FIGS. 5A, 5B, and 5C are diagrams illustrating results of an experiment on subjective evaluations of flicker.
Figure 5B:
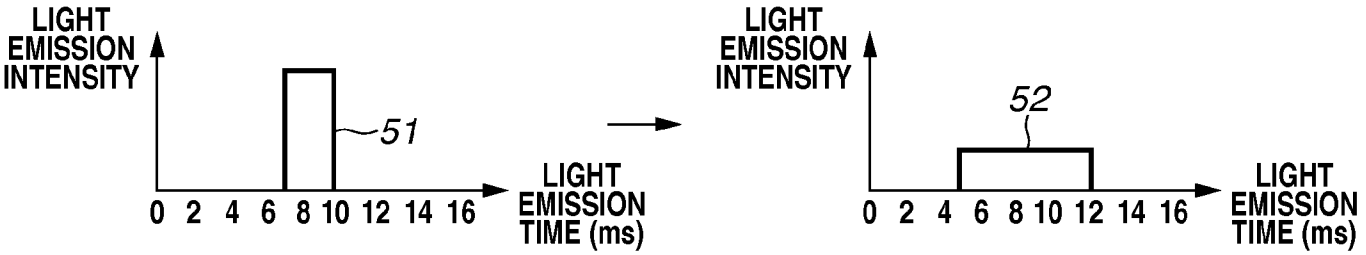
Figure 5C:
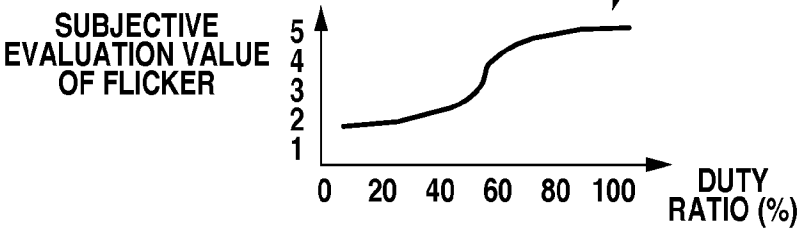

FIGS. 5A, 5B, and 5C are diagrams illustrating the experimentally determined results showing the relationships of the subjective evaluations of flicker to the light emission luminance and light emission time period of a display patch. FIG. 5A illustrates a display patch 50, which has a certain gray scale and a certain area. FIG. 5B illustrates a relationship between the light emission time and the light emission intensity. FIG. 5B illustrates a light emission state 51, where the light emission time period is short and the light emission intensity is high, and a light emission state 52, where the light emission time period is long and the light emission intensity is low. FIG. 5C illustrates a characteristic curve 53, which represents subjective evaluation results. In this experiment, the area of the display patch 50 was set to 300 $cm^2$ so that sufficient flicker occurred, and the display gray scale of the display patch 50 was fixed so that the integrated luminance was 200 $Cd/m^2$.

Under these display conditions, the experiment was performed by adjusting and changing the light emission intensity and the light emission time period so that the display patch 50 had the same integrated luminance. More specifically, the light emission state 51, where the light emission time period was short and the light emission intensity was high, was transitioned to the light emission state 52, where the light emission time period was long and the light emission intensity was low. More specifically, the duty ratio was transitioned from 10% to 100%. From the results of experiment on the subjective evaluations indicated by the characteristic curve 53, it has been found that if the duty ratio is equal to or greater than 70% at a frame frequency of 60 Hz, the subjective evaluation value of flicker is 4, which is the acceptance limit, or above. Further, it has been found that if the duty ratio is equal to or greater than 60%, the subjective evaluation value of flicker is 3, which is the bearable limit, or above.

Figure 6A:
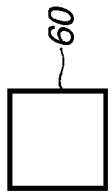
FIGS. 6A, 6B, and 6C are diagrams illustrating results of an experiment on subjective evaluations of flicker.
Figure 6B:
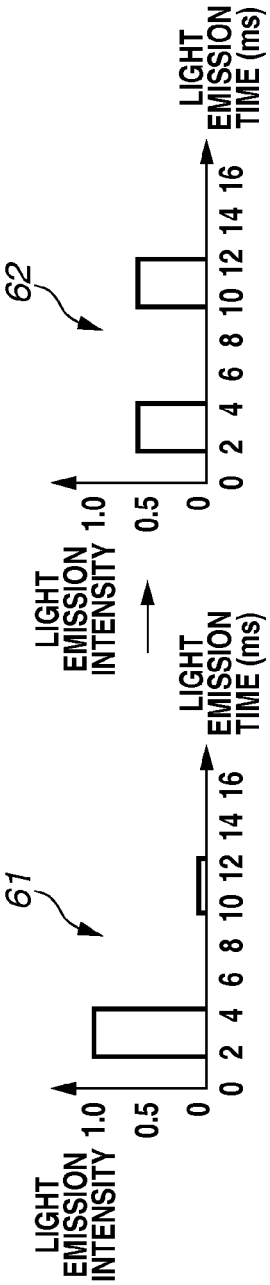
Figure 6C:
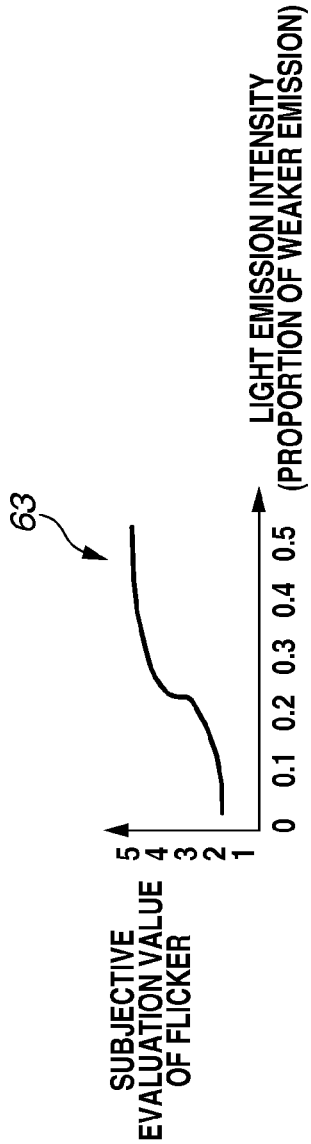

Next, the results of an experiment on flicker when light is emitted twice are illustrated. FIGS. 6A, 6B, and 6C are diagrams illustrating the results of experiment about the relationships of the subjective evaluations of flicker with respect to a display patch that repeatedly emits light with two types of light emission intensity. More specifically, FIG. 6A illustrates a display patch 60, which has a certain integrated luminance and a certain area. FIG. 6B illustrates a relationship between the light emission time and the light emission intensity. FIG. 6B illustrates a light emission state 61, where light is emitted twice within a frequency of 60 Hz and the light emission intensity of the weaker of the two light emissions is 0, and a light emission state 62, where the light emission intensity of the weaker of the two light emissions is 0.5. In this case, the sum of the numbers in the ratio of the light emission intensities is adjusted to be 1.0. FIG. 6C illustrates a characteristic curve 63, which represents subjective evaluation results. In this experiment, the area of the display patch 60 was set to 300 $cm^2$ so that sufficient flicker occurred, and the display gray scale of the display patch 60 was fixed so that the integrated luminance was 200 $Cd/m^2$.

Under these display conditions, the experiment was performed by changing the light emission intensity and the light emission time period while adjusting the ratio of the light emission intensities of the two light emissions so that the display patch 60 had the same integrated luminance. More specifically, the light emission state 61, where only the first light emission was performed and the second light emission was not performed, was transitioned to the light emission state 62, where the first light emission and the second light emission were performed with the same light emission intensity. More specifically, the light emission intensity of the weaker light emission intensity of the two light emissions was transitioned from 0 to 0.5. From the results of experiment about the subjective evaluations indicated by the characteristic curve 63, it has been found that if the relationship between the two light emission intensities is from 0.5:0.5 to 0.7:0.3 at a frame frequency of 60 Hz, the subjective evaluation value is 4, which is the acceptance limit, or above. Further, it has been found that if the relationship between the two light emission intensities is from 0.7:0.3 to 0.8:0.2, the subjective evaluation value is 3, which is the bearing limit, or above.

Figure 7A:
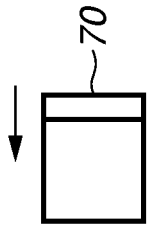
FIGS. 7A, 7B, and 7C are diagrams illustrating the results of an experiment on subjective evaluations of motion blur.
Figure 7B:
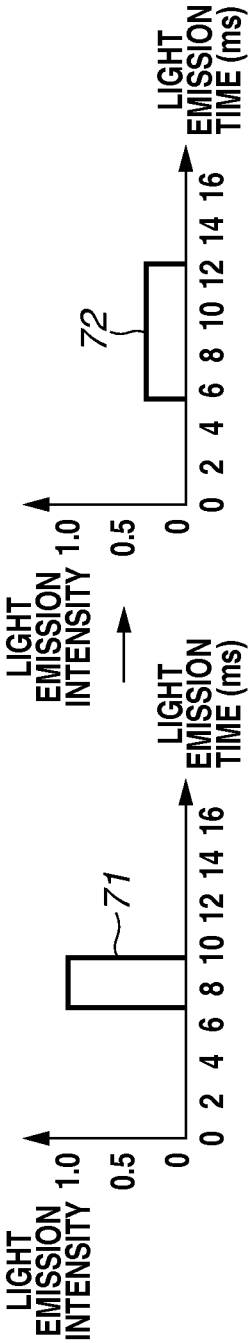
Figure 7C:
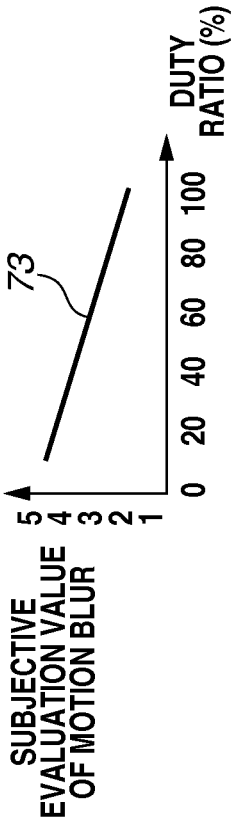

FIGS. 7A, 7B, and 7C are diagrams illustrating the results of experiment about the relationships of the subjective evaluations of motion blur with respect to the light emission time period of a display patch. In other words, FIG. 7A illustrates the state of moving a display patch 70. FIG. 7B illustrates the relationship between the light emission time period and the light emission intensity. More specifically, FIG. 7B illustrates a light emission state 71, where the light emission time period is short and the light emission intensity is high, and a light emission state 72, where the light emission time period is long and the light emission intensity is low. FIG. 7C illustrates a characteristic straight line 73, which represents subjective evaluation results. In this experiment, motion blur was evaluated. Thus, to prevent flicker from being felt, the gray scale was fixed so that the integrated luminance of the display patch 70 was 50 $Cd/m^2$.

Under these display conditions, the experiment was performed by adjusting and changing the light emission intensity and the light emission time period so that the patch 70 had the same integrated luminance. More specifically, the light emission state 71, where the light emission time period was short and the light emission intensity was high, was caused to transition to the light emission state 72, where the light emission time period was long and the light emission intensity was low. Specifically, the duty ratio was caused to transition from 10% to 100%. The results of experiment about the subjective evaluations are indicated by the characteristic straight line 73. From these results, it has been found that if the duty ratio is less than or equal to 30% at a frame frequency of 60 Hz, the subjective evaluation value is 4, which is the acceptance limit, or above, and motion blur can be accepted. Further, it has been found that if the duty ratio is less than or equal to 50%, the subjective evaluation value is 3, which is the bearing limit, or above, and motion blur can be borne.

If the results illustrated in FIGS. 5A, 5B, and 5C to FIGS. 7A, 7B, and 7C are taken into account together, a duty ratio of 70% to 60% or more is desirable in terms of flicker, and a duty ratio of 30% to 50% or less is desirable in terms of motion blur. It is understood that in that case, if light is emitted only once, there is no duty ratio for achieving both the reductions in flicker and motion blur not only at the acceptance limits but also at the bearing limits. Therefore, in the present exemplary embodiment, light is emitted twice to achieve both the reductions in flicker and motion blur.

First, in the present exemplary embodiment, from the results illustrated in FIGS. 7A, 7B, and 7C, the duty ratio of short and bright light emission is set to 30% or less. On this basis, from the results illustrated in FIGS. 6A, 6B, and 6C, if the detected amount of movement is great, the percentage of the integrated luminance of short and bright light emission is increased to about 80% to 70%. If, on the other hand, the amount of movement is small, the percentages of the integrated luminances of short and bright light emission and long and bright light emission are brought close to each other so that the percentage of the integrated luminance of short and bright light emission is about 70% to 50%. This reduces motion blur to its acceptable range within the acceptable range of flicker in most images.

Figure 8A:
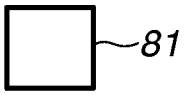
FIGS. 8A and 8B are diagrams illustrating a method of detecting an amount of movement of moving image data.
Figure 8B:
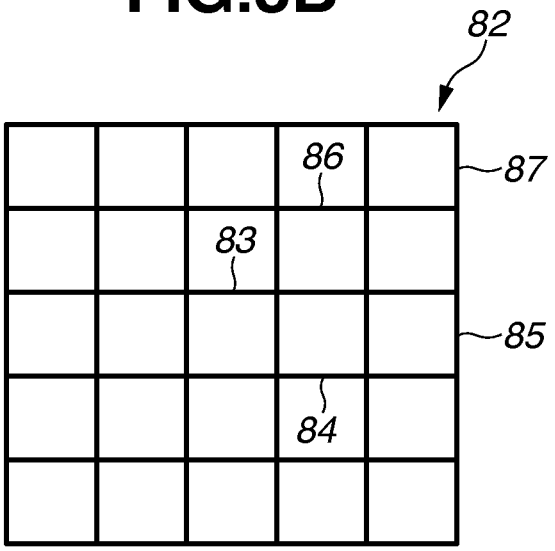

First, with reference to FIGS. 8A and 8B, an example of a method of detecting the amount of movement is described. FIGS. 8A and 8B are diagrams illustrating a method of detecting the amount of movement of moving image data performed by the movement amount calculation circuit 12.

FIG. 8A is a part of the previous image data of two consecutive frames in moving image data and illustrates an area block including several pixels. The area block is obtained by dividing image data into area blocks, each of which includes separate pixel areas of 6×6 pixels as example values. FIG. 8B illustrates a plurality of area blocks in a part of the subsequent image data. As examples of the plurality of area blocks, 5×5 area blocks are illustrated.

In FIGS. 8A and 8B, a block 81 is a block of one region of interest in the previous image data. Further, area blocks 82 are 25 area blocks in the subsequent image data. The area block at the center is at the same position on the screen as that of the area block 81 in the previous image data. An area block 83 is an area block in the subsequent image data at the same position as that of the area block 81. An area block 84 is the first area block to the right of the area block 83. An area block 85 is the second area block to the right of the area block 83. An area block 86 is the first area block to the upper right of the area block 83. An area block 87 is the second area block to the upper right of the area block 83.

In the present exemplary embodiment, to detect the amount of movement, the degree of similarity between the previous image data and each area block in the subsequent image data is examined. It is possible to calculate the degree of similarity by, for example, comparing the area block 81 in the previous image data with each of the 25 area blocks 82 in the subsequent image data, using the root-mean-square value of the differences between corresponding pixels.

In each of the 25 area blocks 82, the root-mean-square value of the differences, which serves as the degree of similarity, is calculated. Then, the area block that takes the minimum root-mean-square value has the highest degree of similarity among the 25 area blocks 82. The degree of similarity is the multiplicative inverse of the root-mean-square value of the differences. Since the gray scale value is from 0 to 255, the root-mean-square value of the differences takes a value from 0 to 255. If the root-mean-square value is divided by 0 to take the multiplicative inverse, an error occurs. Thus, 0 is replaced by 0.5 to take the multiplicative inverse. Consequently, the degree of similarity is a value from 1/255 to 2.

Next, the amount of movement is calculated based on which of the area blocks has the highest degree of similarity. If the area block 83 has the highest degree of similarity, the positions of the previous image data and the subsequent image data are almost the same. Thus, the amount of movement is 0. If the area block 84 has the highest degree of similarity, the positions of the previous image data and the subsequent image data are about 6 pixels away from each other in pixel distance. Thus, the amount of movement is 6. If the area block 85 has the highest degree of similarity, the positions of the previous image data and the subsequent image data are about 12 pixels away from each other. Thus, the amount of movement is 12. If the area block 86 has the highest degree of similarity, the positions of the previous image data and the subsequent image data are about 8 pixels away from each other in an oblique direction. Thus, the amount of movement is 8. If the area block 87 has the highest degree of similarity, the positions of the previous image data and the subsequent image data are about 17 pixels away from each other in an oblique direction. Thus, the amount of movement is 17.

As described above, the amount of movement is calculated based on how many pixels away from the center the area block having the highest degree of similarity is. In this example, the amount of movement takes values 0, 6, 8, 12, 14, and 17 as a value from 0 to 17.

The area blocks in the entire image data are subjected to calculations similar to those of the amount of movement relative to the area block 81. Then, it is possible to calculate the average amount of movement (a screen average movement amount) of the entire image data by taking the root mean square of the amounts of movement of the respective area blocks. This screen average movement amount also takes a value from 0 to 17. As described above, the pixel distance between a region of interest in the previous image and a similar image in the subsequent image is detected using an average value in each area.

In the above description, the degrees of similarity between one area block in the previous image data and 25 area blocks in the subsequent image data are compared. Alternatively, the degrees of similarity between area blocks in the previous image data and one area block in the subsequent image data may be examined.

Next, a method of controlling the light emission intensity and the light emission time period for the detected amount of movement is described. First, the relationship of the appearance with respect to the viewer to the amount of movement is described.

In a case of a full high-definition (HD) panel, panning across 1920 horizontal pixels in 3 seconds is considered to be very fast panning. In this case, the amount of movement per frame is about 10 pixels. Further, panning across 1920 horizontal pixel in 8 seconds is considered to be very slow panning. In this case, the amount of movement per frame is about 4 pixels.

As a criterion for a great amount of movement, a state is defined where the image data moves across 10 pixels or more in half or more of the area of the entire screen. If the screen average movement amount is equal to or greater than half of 10, i.e., 5, as a representative value for the criterion, it is determined that the amount of movement is very large.

On the other hand, as a criterion for a small amount of movement, a state is defined where the image data moves across 4 pixels or less in a quarter or less of the area of the entire screen. If the screen average movement amount is less than or equal to a quarter of 4, i.e., 1, as a representative value for the criterion, it can be said that the amount of movement is very small.

Thus, in the present exemplary embodiment, if the screen average movement amount is equal to or greater than 5, control is performed so that the light emission intensity and the light emission time period place emphasis on movement. Further, if the screen average movement amount is less than or equal to 1, control is performed so that the light emission intensity and the light emission time period place emphasis on stillness. Further, if the screen average movement amount is a value from 1 to 5, the light emission intensity and the light emission time period is controlled so as to prioritize the stillness in order to satisfy both movement and stillness.

The above values are merely illustrative and vary depending on the number of pixels and the size of the display. Thus, it is necessary to use optimal values for each display.

The calculation operation of the light emission intensity/time calculation circuit 21 is described.

First, the values used in calculation formulas are defined as follows. In the following description, "MQ" represents the screen average movement amount. "LMAX" represents the maximum value of the LED light emission intensity. "LLM" represents the integrated luminance when light is emitted with LMAX at a duty ratio of 20%.

First, when only the light emission intensity is controlled with the duty ratio fixed, the values may be set, as an example, as follows.

Conditional processing example 1: MQ>5 (the case of placing emphasis on movement)

Short and bright light emission: duty ratio=20%, LED light emission intensity=0.8 LMAX, integrated luminance=0.8 LLM Long and dark light emission: duty ratio=40%, LED light emission intensity=0.1 LMAX, integrated luminance=0.2 LLM Conditional processing example 2: 1<MQ<5 (the case of achieving both movement and stillness)

Short and bright light emission: duty ratio=20%, LED light emission intensity=(MQ*0.05+0.55) LMAX, integrated luminance=(MQ*0.05+0.55) LLM Long and dark light emission: duty ratio=40%, LED light emission intensity=(0.35−MQ*0.05) LMAX/2, integrated luminance=(0.35−MQ*0.05) LLM Conditional processing example 3: MQ<1 (the case of placing emphasis on stillness)

Figure 9:
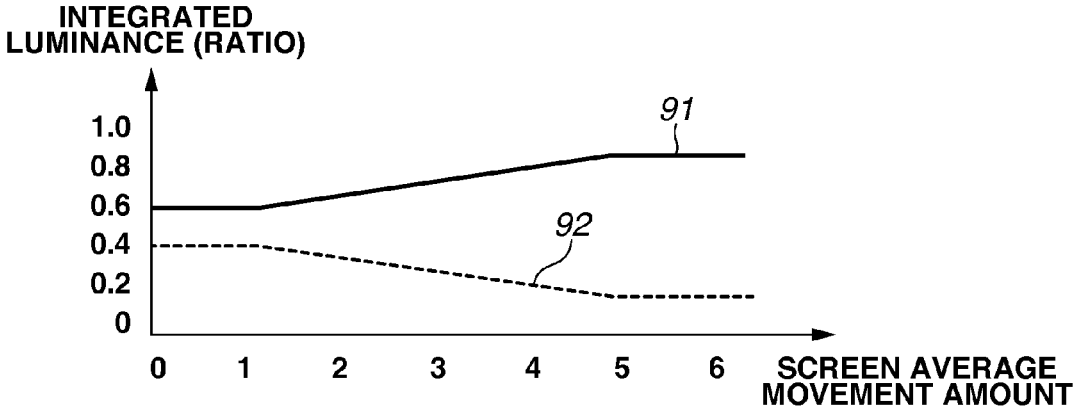
FIG. 9 is a diagram illustrating characteristics in a case where light emission intensities of short and bright light emission and long and dark light emission are variable.

Short and bright light emission: duty ratio=20%, LED light emission intensity=0.6 LMAX, integrated luminance=0.6 LLM Long and dark light emission: duty ratio=40%, LED light emission intensity=0.2 LMAX, integrated luminance=0.4 LLM With reference to FIG. 9, the results of the calculations by the above formulas are described.

FIG. 9 is a characteristic diagram in the case where in the first exemplary embodiment, the light emission intensities of short and bright light emission and long and dark light emission are variable according to the amount of movement. FIG. 9 is a diagram illustrating the relationship between the amount of movement and the integrated luminance. That is, in FIG. 9, the horizontal axis represents the screen average movement amount, and the vertical axis represents the integrated luminance of each light emission by a ratio.

In FIG. 9, a characteristic line 91 represents the integrated luminance of short and bright light emission. A characteristic line 92 represents the integrated luminance of long and dark light emission. If the screen average movement amount is great, short and bright light emission is dominant, and an image with little motion blur is displayed. If a moving portion is large, flicker is less likely to be felt than in a still image, and long and dark light emission has an integrated luminance of 20%. Thus, flicker is at a bearable level. If, on the other hand, the screen average movement amount is small, the proportion of the integrated luminance of short and bright light emission to the integrated luminance of long and dark light emission comes close to about 1.5 times, and a stable image is displayed in which flicker is prevented.

Next, as another example of the calculation operation of the light emission intensity/time calculation circuit 21, a case is described where the duty ratio is changed with the light emission intensity held constant.

The ratio of the light emission intensity corresponding to short and bright light emission is set to 0.8, and the ratio of the light emission intensity corresponding to long and dark light emission is fixed to 0.2. The duty ratio corresponding to short and bright light emission is set to 0.1 to 0.2, and the duty ratio corresponding to long and dark light emission is changed in the range of 0.2 to 0.6.

Conditional processing example 4: MQ>5 (the case of placing emphasis on movement)

Short and bright light emission: duty ratio=0.2, LED light emission intensity=0.8 LMAX, integrated luminance=0.8 LLM Long and dark light emission: duty ratio=0.2, LED light emission intensity=0.2 LMAX, integrated luminance=0.2 LLM Conditional processing example 5: 1<MQ<5 (the case of achieving both movement and stillness)

Short and bright light emission: duty ratio=((MQ−1)*0.025+0.1), LED light emission intensity=0.8 LMAX, integrated luminance=4((MQ−1)*0.025+0.1) LLM Long and dark light emission: duty ratio=(0.6−(MQ−1)*0.1), LED light emission intensity=0.2 LMAX, integrated luminance=(0.6−(MQ−1)*0.1) LLM Conditional processing example 6: MQ<1 (the case of placing emphasis on stillness)

Figure 10:
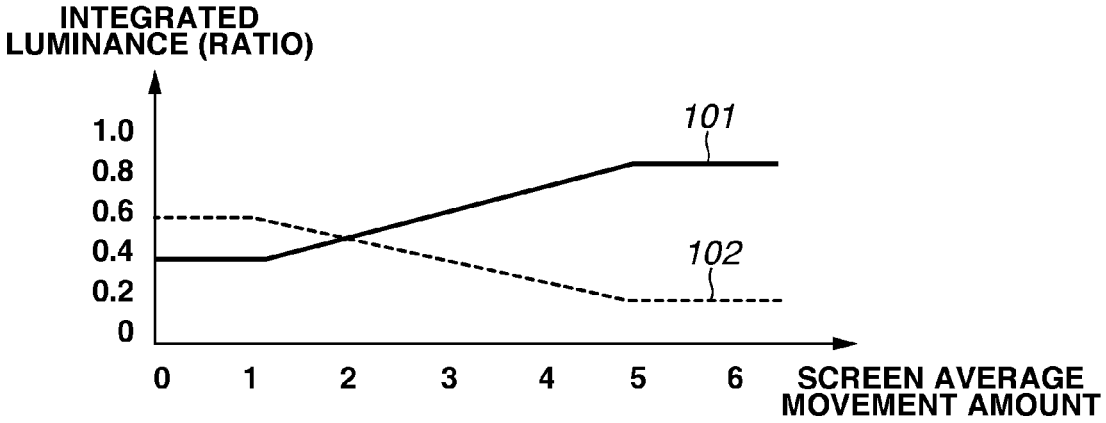
FIG. 10 is a diagram illustrating characteristics in a case where the duty ratios of short and bright light emission and long and dark light emission are variable.

Short and bright light emission: duty ratio=0.1, LED light emission intensity=0.8 LMAX, integrated luminance=0.4 LLM Long and dark light emission: duty ratio=0.6, LED light emission intensity=0.2 LMAX, integrated luminance=0.6 LLM With reference to FIG. 10, the results of the calculations by the above formulas are described.

FIG. 10 is a characteristic diagram in the case where in the first exemplary embodiment of the present invention, the duty ratios of short and bright light emission and long and dark light emission are variable according to the amount of movement. FIG. 10 illustrates a relationship between a screen average movement amount and an integrated luminance. That is, in FIG. 10, the horizontal axis represents the screen average movement amount, and the vertical axis represents the integrated luminance (ratio) of each light emission.

In FIG. 10, a characteristic line 101 represents the integrated luminance of short and bright light emission. A characteristic line 102 represents the integrated luminance of long and dark light emission. Also in this example, if the screen average movement amount is great, short and bright light emission is dominant, and an image with little motion blur is displayed. If, on the other hand, the screen average movement amount is small, the integrated luminance of long light emission is increased. Thus, the time light is emitted is longer, and a stable image is displayed in which flicker is further prevented.

Further, the light emission intensity/time calculation circuit 21 may change both the light emission intensity and the light emission time period. Also in this case, the ratio of the integrated luminances may be controlled similarly to the above example and therefore is not described in detail here.

Next, the output of the light emission intensity/time calculation circuit 21 based on the calculation results is described. At this time, too many patterns of the light emission intensity and the light emission time period for the amount of movement would lead to cumbersomeness. Thus, it is reasonable to prepare, for example, about 10 patterns. In the present exemplary embodiment, any of the 10 patterns is written to the LED controller 22, and the LED controller 22 controls the drivers 25.

The relationships between the screen average movement amount and the patterns are defined as follows. In the following description, "MQA" represents the screen average movement amount, and "Px" represents a pattern x.

MQA<1→P1
1<MQA≤1.5→P2
1.5<MQA≤2→P3
2<MQA≤2.5→P4
2.5<MQA≤3→P5
3<MQA≤3.5→P6
3.5<MQA≤4→P7
4<MQA≤4.5→P8
4.5<MQA≤5→P9
5<MQA→P10

In the cases of the above conditional processing examples 1, 2, and 3, the following values are used as examples.

Duty ratio of short and bright light emission: fixed to 0.2

Duty ratio of long and dark light emission: fixed to 0.4

P1: light emission intensity of short and bright light emission=0.6, light emission intensity of long and dark light emission=0.2

P2: light emission intensity of short and bright light emission=0.625, light emission intensity of long and dark light emission=0.1875

P3: light emission intensity of short and bright light emission=0.65, light emission intensity of long and dark light emission=0.175

P4: light emission intensity of short and bright light emission=0.675, light emission intensity of long and dark light emission=0.1625

P5: light emission intensity of short and bright light emission=0.7, light emission intensity of long and dark light emission=0.15

P6: light emission intensity of short and bright light emission=0.725, light emission intensity of long and dark light emission=0.1375

P7: light emission intensity of short and bright light emission=0.75, light emission intensity of long and dark light emission=0.125

P8: light emission intensity of short and bright light emission=0.775, light emission intensity of long and dark light emission=0.1125

P9: light emission intensity of short and bright light emission=0.8, light emission intensity of long and dark light emission=0.1

P10: light emission intensity of short and bright light emission=0.8, light emission intensity of long and dark light emission=0.1

Also in the cases of conditional processing examples 4, 5, and 6, the duty ratio can be determined for each pattern based on the above calculation formulas, and therefore, a description is omitted. The same applies to the case of changing both the light emission intensity and the duty ratio, and therefore, a description is omitted.

Each of these patterns is written into the LED controller 22 for each frame. Thus, it is possible to control the drivers 25 to control the light emission intensity and the light emission time period of the LEDs as described above.

The present invention can be applied not only to the first exemplary embodiment but also to a different exemplary embodiment that includes similar components. For example, the light-emitting device 20 according to the first exemplary embodiment has been described taking as an example a scanning method in which the LEDs 26 and 27 are arranged to the left and right of the light guide plate 28. The present invention, however, is not limited to this case. Alternatively, the present invention can similarly achieve also the case of causing all the LEDs to simultaneously emit light.

Further, the present invention can similarly achieve also the configuration in which many LED blocks are placed directly under the back side of a panel, and the light emission intensity and the light emission time period are controlled with respect to each LED block.

Figure 11:
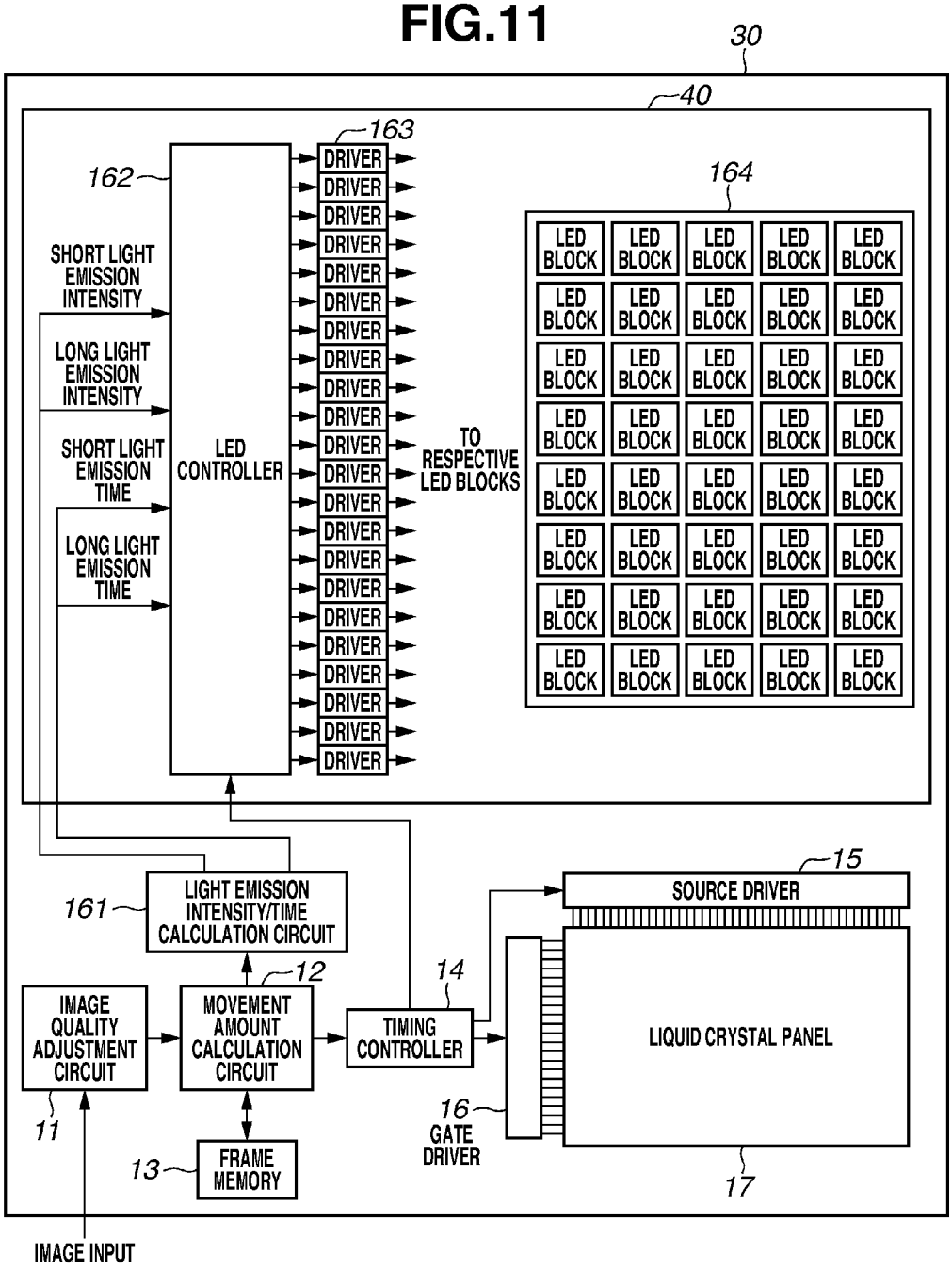
FIG. 11 is a block diagram illustrating a configuration of a display apparatus according to an exemplary embodiment.

FIG. 11 is a block diagram illustrating an example of a configuration of a display apparatus using a direct backlight, according to a second exemplary embodiment of the present invention.

In FIG. 11, a display apparatus 30 includes a light-emitting device (direct backlight device) 40. The light-emitting device 40 employs a local dimming method in which a plurality of LED blocks is placed directly under a liquid crystal panel and each LED block independently emits light.

In FIG. 11, components 11 to 17 are similar to those in FIG. 2. A light emission intensity/time calculation circuit 161 calculates the light emission intensity and the light emission time period of LEDs according to the amount of movement of each LED block. An LED controller 162 controls an LED driver of each LED block according to the light emission intensity and the light emission time period calculated by the light emission intensity/time calculation circuit 161.

Drivers 163 drive LEDs with respect to each LED block. A group of LED blocks 164 include 40 LED blocks in FIG. 11. Each LED block includes, for example, LEDs of white or three RGB colors and a diffusion plate.

In the following description of the general operation of the display apparatus 30, the components similar to those of the display apparatus 10 in FIG. 2 are not described here. The movement amount calculation circuit 12 calculates the amount of movement of an image to be displayed on the liquid crystal panel 17 on the front surface, with respect to each of the areas corresponding to the respective LED blocks. If the liquid crystal panel 17 has full HD resolution, 1920×1080 pixels are included. Thus, if the liquid crystal panel 17 is divided into 5 horizontal blocks and 8 vertical blocks, the size of each LED block is 384×135 pixels. In the present exemplary embodiment, the movement amount calculation circuit 12 calculates the amount of movement of every 6×6 pixels in each LED block, using a technique described above with reference to FIGS. 8A and 8B. Then, the root mean square of the amount of movement of every 6×6 pixels in each LED block is taken to obtain the average movement amount of the LED block.

Next, based on the average movement amount of each LED block, the light emission intensity/time calculation circuit 161 tentatively determines the light emission intensity and the light emission time period of the LED block.

This tentative determination method is as described above with reference to FIGS. 9 and 10. If, however, the light emission has been controlled based on the tentatively determined light emission intensity and light emission time period of each LED block, and the light emission patterns of adjacent LED blocks are greatly different from each other, the resulting image gives a sense of discomfort in the boundary portion between the adjacent LED blocks. For example, if the pattern 10, which is a pattern suitable for a moving image, is adjacent to the pattern 2, which is a light emission pattern suitable for a still image, the manner of occurrence of moving image blur differs in each LED block. Thus, the resulting image gives a sense of discomfort.

Therefore, in the present exemplary embodiment, an averaging process is performed using, for example, low-pass filters so that the values of adjacent LED blocks come close to each other. Another process without the use of low-pass filters may be applied so long as the process reduces the difference in value between adjacent LED blocks.

FIG. 12 is a diagram illustrating a pattern determination method of the light emission intensity/time calculation circuit 161.

In FIG. 12, values 121 illustrate examples of tentatively determined pattern values of the respective LED blocks. Values 122 illustrate pattern values of the respective LED blocks subjected to an averaging process using low-pass filters. A low-pass filter 123 includes coefficients used for blocking in a center portion. A low-pass filter 124 includes coefficients used for blocking in a side end portion. A low-pass filter 125 includes coefficients used for blocking in a corner portion.

In FIG. 12, the tentatively determined pattern values 121 are merely illustrative. In the examples of the pattern values 121 in FIG. 12, there are many portions where the difference between adjacent LED blocks is great, and the maximum difference is 9. In a portion where the difference is great, the manner of occurrence of motion blur greatly differs at the boundary as described above and therefore gives a sense of discomfort, which needs to be reduced.

Therefore, the light emission intensity/time calculation circuit 161 performs averaging by passing the pattern values 121 through one of the low-pass filters 123, 124, and 125 according to the position of each LED block, thereby obtaining the pattern values 122. The differences between adjacent blocks are totally reduced, and the maximum difference is also reduced to 6.

Next, the light emission intensity/time calculation circuit 161 writes the determined light emission intensity and light emission time period of the LEDs to a register of the LED controller 162. The LED controller 162 converts the values written in the register into a driving voltage and an output time, thereby driving the drivers 163. The number of the drivers 163 is the same as that of the LED blocks. In this example, 40 drivers are required. The drivers 163 drive the LED blocks 164 using a current proportional to the input voltage.

Also in a case of a direct backlight, the LED controller 162 controls a scanning operation. The scanning operation is a control for sequentially shifting the operation of turning on and then off each driver 163 from an upper driver to a lower driver. The time during which each driver 163 is turned on is controlled as the hold time to obtain a desired duty ratio. The driven LED blocks emit light in a bright or dark manner based on the current value. The light from the LED blocks 164 passes through the diffusion plates (not illustrated) and is provided to the liquid crystal panel 17.

As described above, in the second exemplary embodiment, short and bright light emission is strengthened in an LED block where the movement is great, and long and dark light emission is strengthened in an LED block where the movement is small. Consequently, the appearance of tailing based on the movement of an image is such that long tailing with movement is displayed in a pale manner, and short tailing with little movement is displayed in a deep manner. This results in a desirable appearance close to natural.

Further, the light-emitting device 40 according to the present exemplary embodiment can lower the intensity of short and bright light emission for the original image in an LED block where the maximum gray scale value is small.

Thus, it is also possible to display image data in such a manner that a dark portion is black and sharp.

Further, in the first and second exemplary embodiments, a display apparatus including a liquid crystal panel has been described. The present invention, however, can be applied not only to this case but also to a display apparatus such as a liquid crystal projector and a display apparatus including a hold-type display device such as an organic electroluminescence (EL) panel.

Next, a third exemplary embodiment of the present invention is described. In the third exemplary embodiment, a case is described where the light emission luminance and the light emission time period are controlled in a liquid crystal projector using a lamp. In terms of responsiveness, it is difficult to control the light emission intensity of a lamp step by step based on the current value similarly to LEDs to control the light emission luminance. Thus, in the third exemplary embodiment, the light emission luminance and the light emission time period are controlled using a diaphragm.

Figure 13:
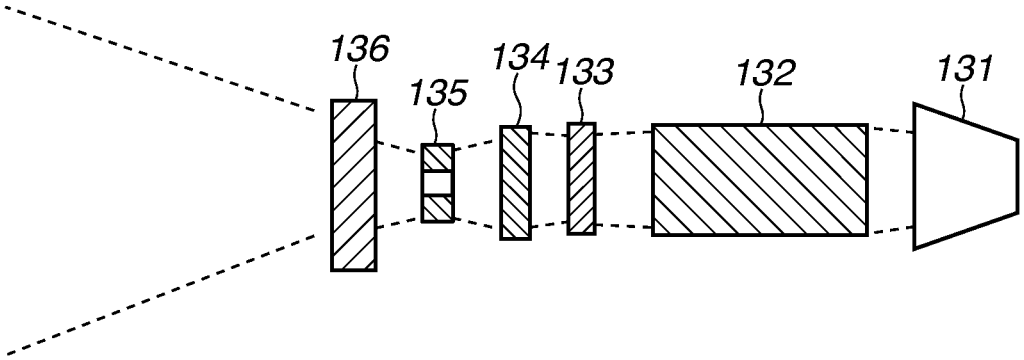
FIG. 13 is a diagram illustrating an example of the configuration of a liquid crystal projector according to an exemplary embodiment.

FIG. 13 is a diagram illustrating a general configuration of a liquid crystal projector.

In FIG. 13, a lamp 131 serves as a light source. FIG. 13 also includes a light concentration adjustment optical system 132, a transmissive liquid crystal panel 133, a lens 134, a diaphragm 135, and a projection lens 136.

The light emitted from the lamp 131 is concentrated by the light concentration adjustment optical system 132 and guided as parallel light to the liquid crystal panel 133. The light having formed an image on the liquid crystal panel 133 is guided to the diaphragm 135 by the lens 134 and reduced according to the degree of opening of the diaphragm 135. The reduced light is projected onto a screen (not illustrated) by the projection lens 136.

Figure 14A:
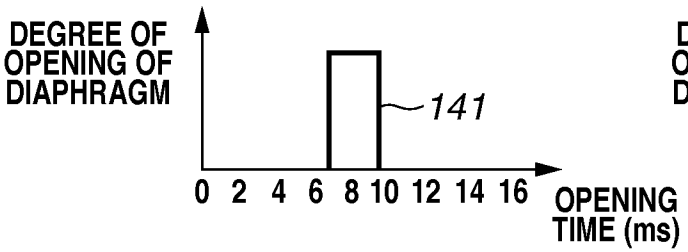
FIGS. 14A, 14B, 14C, and 14D are diagrams illustrating a diaphragm control of the liquid crystal projector.
Figure 14B:
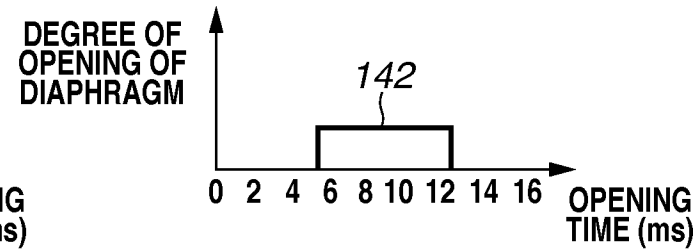
Figure 14C:
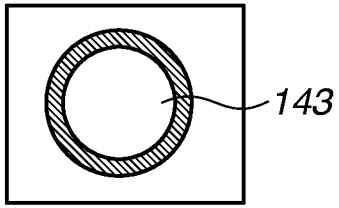
Figure 14D:
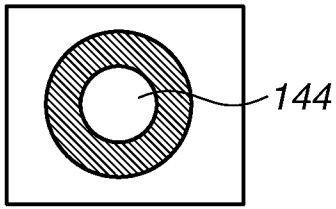

FIGS. 14A, 14B, 14C, and 14D are diagrams illustrating a diaphragm control of the liquid crystal projector. More specifically, FIG. 14A illustrates a state 141, where the diaphragm 135 is opened for a short time such that the degree of opening of the diaphragm 135 is large. FIG. 14C illustrates a state 143, where the degree of opening of the diaphragm 135 is large. FIG. 14B illustrates a state 142, where the diaphragm 135 is opened for a long time such that the degree of opening of the diaphragm 135 is small. FIG. 14D illustrates a state 144, where the degree of opening of the diaphragm 135 is small. The degree of opening and the opening time of the diaphragm 135 are thus changed. Thus, it is possible to simultaneously control both the light emission luminance and the light emission time period of even a lamp similarly to LEDs.

Figure 15:
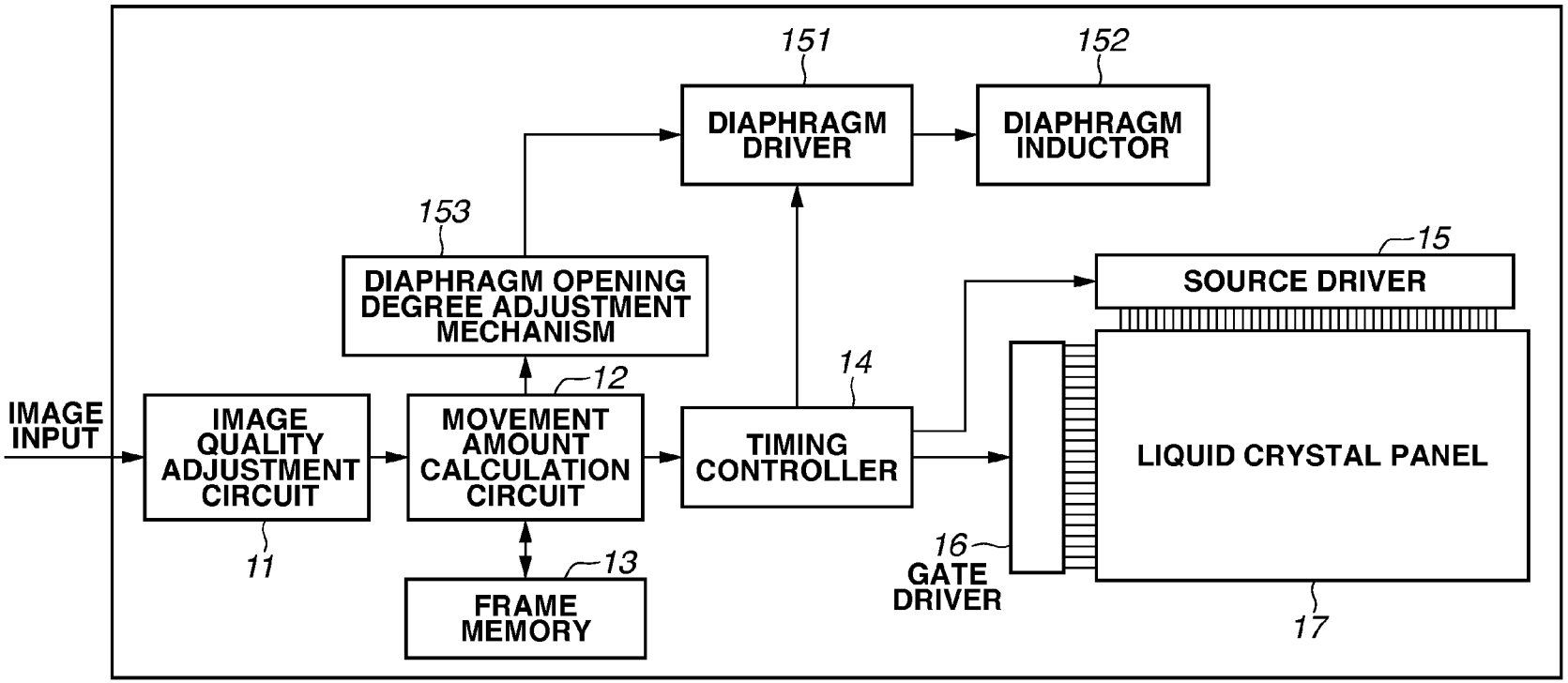
FIG. 15 is a block diagram illustrating an example of a configuration of the liquid crystal projector.

FIG. 15 is a diagram illustrating an internal configuration of the liquid crystal projector according to the third exemplary embodiment of the present invention. The components similar to those of the display apparatus 10 according to the first exemplary embodiment illustrated in FIG. 2 are designated by the same numerals and are not described here.

In FIG. 15, a diaphragm driver 151 drives the diaphragm 135. FIG. 15 also illustrates a diaphragm inductor 152 and a diaphragm opening degree adjustment mechanism 153. The ease of occurrence of motion blur is detected by the movement amount calculation circuit 12 similarly to the first exemplary embodiment. According to the result of the detection, the diaphragm opening degree adjustment mechanism 153 controls the light emission luminance and the light emission time period similarly to the first exemplary embodiment. More specifically, in the present exemplary embodiment, since the diaphragm 135 is used, the light emission luminance of the lamp 131 is controlled using the diaphragm opening degree adjustment mechanism 153. Further, in the present exemplary embodiment, the time from the opening of the diaphragm 135 using the diaphragm driver 151 and the diaphragm inductor 152 to the closing of the diaphragm 135 is adjusted, thereby controlling the light emission time period of the lamp 131.

Next, a fourth exemplary embodiment of the present invention is described. In the fourth exemplary embodiment, a case is described where the light emission luminance and the light emission time are controlled in a liquid crystal projector using LEDs. The liquid crystal projector uses LED devices as a light source, and thereby can have almost the same configuration as that of the first exemplary embodiment. The fourth exemplary embodiment is different from the first exemplary embodiment in that the LEDs arranged vertically in a line in FIG. 1 are replaced by a single white LED or RGB LEDs.

The above first to fourth exemplary embodiments have been described on the assumption that the frame rate is the same as that of an image input, for example, 60 Hz. There is a technique for generating intermediate image data to be inserted among the original image data and multiplying the frame frequency by a constant value, thereby improving motion blur. In this technique, however, the image quality of the frame in the intermediate image data deteriorates relative to the image quality of the frame in the original image data. Therefore, in the present exemplary embodiment, when an image including intermediate image data is used as an input image, short and bright light emission is used for the original image data, and long and dark light emission is used for the intermediate image data. This causes the deteriorated intermediate image data to be inconspicuous and therefore produces an excellent result.

Next, a fifth exemplary embodiment of the present invention is described. In the fifth exemplary embodiment, an example is described where a display apparatus including a light-emitting device having a plurality of LED blocks generates intermediate image data to be inserted among the original image data and multiplies the frame frequency by a constant.

Figure 16:
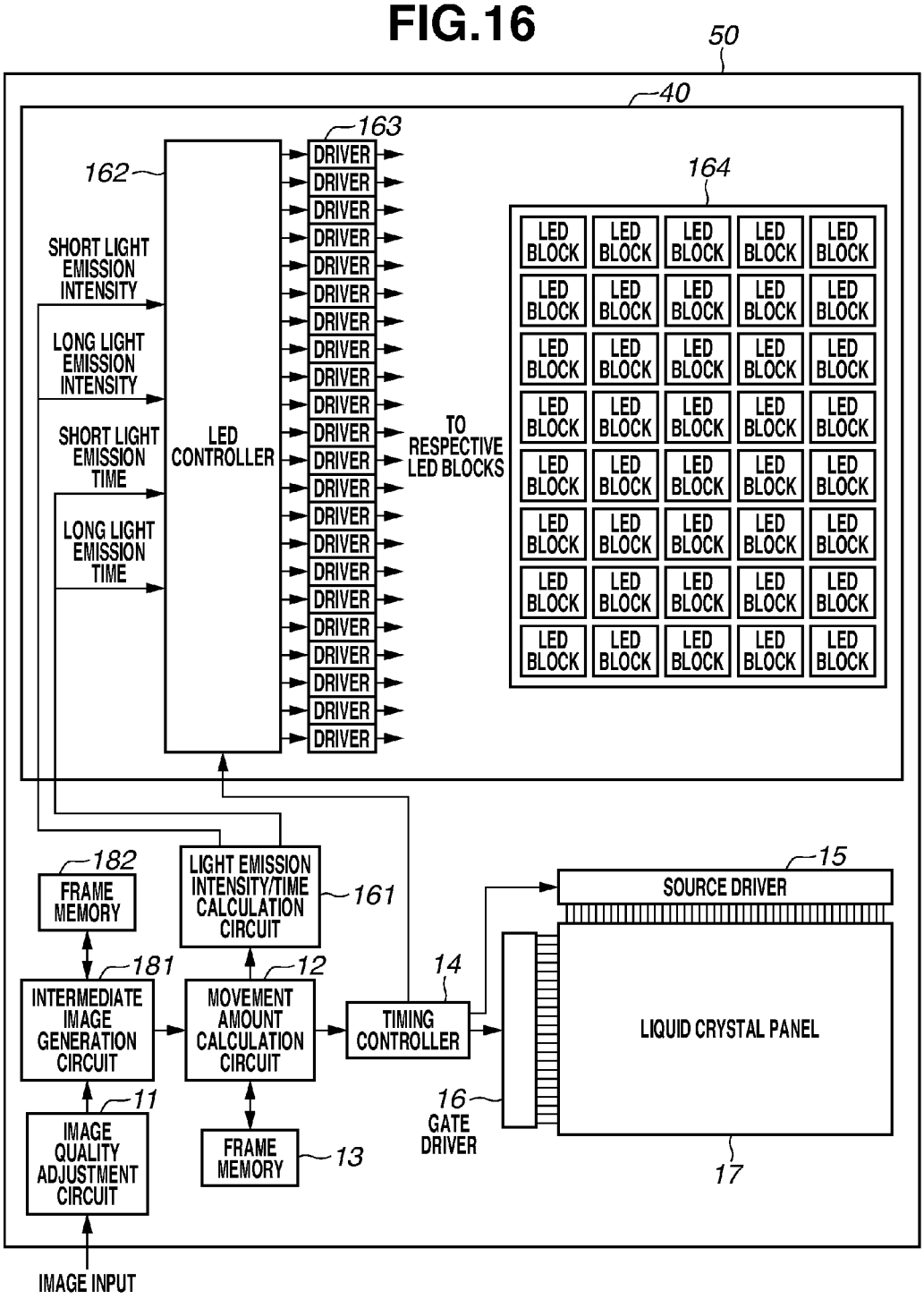
FIG. 16 is a block diagram illustrating an example of a configuration of a display apparatus according to an exemplary embodiment.

FIG. 16 is a block diagram illustrating an example of an internal configuration of a display apparatus according to the fifth exemplary embodiment. A display apparatus 50 according to the fifth exemplary embodiment includes a light-emitting device (backlight device) 40. The light-emitting device 40 employs a local dimming method, in which a plurality of LED blocks is arranged, different light emission is performed with respect to each LED block, and the LED blocks sequentially emit light from the top.

Components 11, 12, 13, 14, 15, 16, 17, 161, 162, 163, and 164 of the display apparatus 50 are similar to those in FIG. 11 and therefore are not described here. An intermediate image generation circuit 181 generates intermediate image data from the original image data. A frame memory 182 is a memory connected to the intermediate image generation circuit 181.

The intermediate image generation circuit 181 generates, from two consecutive images of the original image data having a frame frequency of 60 Hz, intermediate image data that is intermediate between the two consecutive images. Then, the intermediate image generation circuit 181 outputs the intermediate image data as image data having a frame frequency of 120 Hz. The intermediate image generation circuit 181 accumulates old image data in the frame memory 182 to use two images of the original image data, and then generates intermediate image data from new image data and the old image data read from the frame memory 182. The technique for generating intermediate image data is a general technique and therefore is not described in detail here.

The intermediate image data is image data generated by calculating the amount of movement, and therefore, the image quality of the intermediate image data deteriorates particularly in a moving portion as compared to the original image data. If such intermediate image data is displayed as it is among the original image data, motion blur is displayed with a sense of discomfort. This causes the viewer to feel a sense of obstruction.

Therefore, in the fifth exemplary embodiment, display is performed at a frame frequency of 120 Hz using the intermediate image data, while the light-emitting device 40 performs long and dark light emission for the intermediate image data. This blurs the deteriorated portion of the intermediate image data that occurs in a portion with movement. Thus, the viewer is unlikely to feel a sense of obstruction. As described above, according to the fifth exemplary embodiment, it is possible to prevent flicker while eliminating a sense of obstruction caused by motion blur which gives a sense of discomfort in a moving portion.

Further, in the fifth exemplary embodiment, it is possible to lower the light emission intensity of short and bright light emission for the original image data in a block where the maximum gray scale value is small. Thus, it is also possible to display image data so that a dark portion is black and sharp.

Thus, in the fifth exemplary embodiment, when display is performed at a frame frequency of 120 Hz using intermediate image data, only the flicker in a bright portion is reduced. Thus, it is possible to display image data in such a manner that a black portion of the image has little black floating, while a moving portion deteriorates less.

While the present invention has been described based on various exemplary embodiments, the present invention is not limited to these exemplary embodiments, but can be changed within the scope of the present invention. For example, the light-emitting devices 20 to 40 may include the image quality adjustment circuit 11, the movement amount calculation circuit 12, and the timing controller 14.

The present invention can be widely used for a television including a hold-type display device such as a liquid crystal panel and an organic EL panel, a display apparatus such as a monitor with a separate tuner and a personal computer (PC) monitor, and a backlight used for a display apparatus.

According to the present invention, it is possible to reduce the occurrence of flicker in a nearly still image and also reduce the occurrence of motion blur in an image with movement.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-180123 filed Aug. 30, 2013, which is hereby incorporated by reference herein in its entirety.

What is claimed is:

1. A display control apparatus comprising:

at least one processor; and a memory for storing instructions to be executed by the at least one processor, wherein when the instructions stored in the memory are executed by the processor, the at least one processor operates to:

detect movement information from image data; and based on image data corresponding to one image frame, cause a display to perform a plurality of light emissions including at least a first light emission and a second light emission so that a difference between a first light emission amount and a second light emission amount is greater in a case where the detected movement information indicates a higher motion amount than a predetermined threshold in comparison with a case where the detected movement information indicates a lower motion amount than the predetermined threshold, wherein the first light emission amount is determined based on both of a light emission time period of the first light emission and a light emission luminance of the first light emission, wherein the second light emission amount is determined based on both of a light emission time period of the second light emission and a light emission luminance of the second light emission, and wherein the light emission luminance of the first light emission is not lower than the light emission luminance of the second light emission and the light emission time period of the first light emission is not longer than the light emission time period of the second light emission.

2. The display control apparatus according to claim 1, wherein the at least one processor operates to control the light emission luminances of the first light emission and the second light emission according to the detected movement information.

3. The display control apparatus according to claim 1, wherein the at least one processor operates to control the light emission time periods of the first light emission and the second light emission according to the detected movement information.

4. The display control apparatus according to claim 1, wherein the at least one processor operates to detect the movement information with respect to each of predetermined areas of the image data, and to control the first light emission and the second light emission based on an average amount of movement indicated by the movement information detected at the respective predetermined areas.

5. The display control apparatus according to claim 1, wherein the at least one processor operates to detect the movement information with respect to each of predetermined areas of the image data, and to control the first light emission and the second light emission with respect to each predetermined area based on the detected movement information of the predetermined area.

6. The display control apparatus according to claim 1, wherein the at least one processor further operates to generate an intermediate frame from adjacent input image frames, and wherein the at least one processor operates to control the first light emission such that an image frame based on an input image frame is displayed, and to control the second light emission such that the intermediate frame is displayed.

7. A method for controlling a display control apparatus, comprising:

detecting movement information from image data; and based on image data corresponding to one image frame, controlling a display to perform a plurality of light emissions including at least a first light emission and a second light emission so that a difference between a first light emission amount and a second light emission amount is greater in a case where the detected movement information indicates a higher motion amount than a predetermined threshold in comparison with a case where the detected movement information indicates a lower motion amount than the predetermined threshold, wherein the first light emission amount is determined based on both of a light emission time period of the first light emission and a light emission luminance of the first light emission, wherein the second light emission amount is determined based on both of a light emission time period of the second light emission and a light emission luminance of the second light emission, and wherein the light emission luminance of the first light emission is not lower than the light emission luminance of the second light emission and the light emission time period of the first light emission is not longer than the light emission time period of the second light emission.

8. The method according to claim 7, wherein in the controlling, the light emission luminances of the first light emission and the second light emission are controlled according to the detected movement information.

9. The method according to claim 7, wherein in the controlling, the light emission time periods of the first light emission and the second light emission are controlled according to the detected movement information.

10. The method according to claim 7, wherein in the detecting, the movement information is detected with respect to each of predetermined areas of the image data, and in the controlling, the first light emission and the second light emission are controlled based on an average value of amounts of movement indicated by the pieces of movement information of the respective predetermined areas.

11. The method according to claim 7, wherein in the detecting, the movement information is detected with respect to each of predetermined areas of the image data, and in the controlling, the first light emission and the second light emission are controlled with respect to each predetermined area based on the movement information of the predetermined area.

12. A non-transitory computer-readable storage medium storing a program for causing a computer to execute a method, the method comprising:

detecting movement information from image data; and based on image data corresponding to one image frame, controlling a display to perform a plurality of light emissions including at least a first light emission and a second light emission so that a difference between a first light emission amount and a second light emission amount is greater in a case where the detected movement information indicates a higher motion amount than a predetermined threshold in comparison with a case where the detected movement information indicates a lower motion amount than the predetermined threshold, wherein the first light emission amount is determined based on both of a light emission time period of the first light emission and a light emission luminance of the first light emission, wherein the second light emission amount is determined based on both of a light emission time period of the second light emission and a light emission luminance of the second light emission, and wherein the light emission luminance of the first light emission is not lower than the light emission luminance of the second light emission and the light emission time period of the first light emission is not longer than the light emission time period of the second light emission.

13. The non-transitory computer-readable storage medium according to claim 12, wherein, in the controlling, the light emission luminances of the first light emission and the second light emission are controlled according to the detected movement information.

14. The non-transitory computer-readable storage medium according to claim 12, wherein, in the controlling, the light emission time periods of the first light emission and the second light emission are controlled according to the detected movement information.

15. The non-transitory computer-readable storage medium according to claim 12, wherein, in the detecting, the movement information is detected with respect to each of predetermined areas of the image data, and in the controlling, the first light emission and the second light emission are controlled based on an average value of amounts of movement indicated by the pieces of movement information of the respective predetermined areas.

16. The non-transitory computer-readable storage medium according to claim 12, wherein, in the detecting, the movement information is detected with respect to each of predetermined areas of the image data, and in the controlling, the first light emission and the second light emission are controlled with respect to each predetermined area based on the movement information of the predetermined area.

17. The display control apparatus according to claim 1, wherein the first light emission amount corresponds to an integrated value based on the light emission luminance of the first light emission and the light emission time period of the first light emission, and wherein the second light emission amount corresponds to an integrated value based on the light emission luminance of the second light emission and the light emission time period of the second light emission.

18. A display control apparatus comprising:

at least one processor; and a memory for storing instructions to be executed by the at least one processor, wherein when the instructions stored in the memory are executed by the processor, the at least one processor operates to:

detect movement information from image data; and based on image data corresponding to one image frame, cause a display to perform a plurality of light emissions including at least a first light emission and a second light emission so that a difference between a first light emission amount and a second light emission amount is greater in a case where the detected movement information indicates a higher motion amount than a predetermined threshold in comparison with a case where the detected movement information indicates a lower motion amount than the predetermined threshold, wherein the first light emission amount is determined based on both of a light emission time period of the first light emission and a light emission luminance of the first light emission, wherein the second light emission amount is determined based on both of a light emission time period of the second light emission and a light emission luminance of the second light emission, and wherein the light emission luminance of the first light emission is not lower than the light emission luminance of the second light emission and the light emission time period of the first light emission is not longer than the light emission time period of the second light emission, and wherein the at least one processor operates to detect the movement information with respect to each of predetermined areas of the image data, and to control the first light emission and the second light emission based on an average amount of movement indicated by the movement information detected at the respective predetermined areas.

19. A display control apparatus comprising:

at least one processor; and a memory for storing instructions to be executed by the at least one processor, wherein when the instructions stored in the memory are executed by the processor, the at least one processor operates to:

detect movement information from image data; and based on image data corresponding to one image frame, cause a display to perform a plurality of light emissions including at least a first light emission and a second light emission so that a difference between a first light emission amount and a second light emission amount is greater in a case where the detected movement information indicates a higher motion amount than a predetermined threshold in comparison with a case where the detected movement information indicates a lower motion amount than the predetermined threshold, wherein the first light emission amount is determined based on both of a light emission time period of the first light emission and a light emission luminance of the first light emission, wherein the second light emission amount is determined based on both of a light emission time period of the second light emission and a light emission luminance of the second light emission, and wherein the light emission luminance of the first light emission is not lower than the light emission luminance of the second light emission and the light emission time period of the first light emission is not longer than the light emission time period of the second light emission, wherein the at least one processor further operates to generate an intermediate frame from adjacent input image frames, and wherein the at least one processor operates to control the first light emission such that an image frame based on an input image frame is displayed, and to control the second light emission such that the intermediate frame is displayed.

* * * * *